US007878090B2

(12) United States Patent
Leupert

(10) Patent No.: US 7,878,090 B2
(45) **Date of Patent: *Feb. 1, 2011**

(54) HANDHELD POWER TOOL, IN PARTICULAR A POWER DRILL OR SCREWDRIVER

(75) Inventor: Markus Leupert, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 15 days.

This patent is subject to a terminal disclaimer.

(21) Appl. No.: 12/109,430

(22) Filed: Apr. 25, 2008

(65) Prior Publication Data

US 2008/0264212 A1 Oct. 30, 2008

(30) Foreign Application Priority Data

Apr. 25, 2007 (DE) ..... 10 2007 019 434

(51) Int. Cl.
*B25B 21/00* (2006.01)
*B25B 23/18* (2006.01)

(52) U.S. Cl. ..... 81/57.11; 362/119

(58) Field of Classification Search ..... 81/57.11, 81/57.24; 362/119

See application file for complete search history.

(56) References Cited

U.S. PATENT DOCUMENTS

| | | | | |
|---|---|---|---|---|
| 3,141,171 | A * | 7/1964 | Doyle et al. | 227/2 |
| 4,162,639 | A * | 7/1979 | Gill | 81/429 |
| 4,712,456 | A * | 12/1987 | Yuan | 81/473 |
| 5,557,990 | A * | 9/1996 | Shin | 81/54 |
| 7,008,076 | B2 * | 3/2006 | Zirk et al. | 362/119 |

* cited by examiner

*Primary Examiner*—David B Thomas
(74) *Attorney, Agent, or Firm*—Ronald E. Greigg

(57) ABSTRACT

A handheld power tool, in particular a power drill or power screwdriver, has a tool holder, which is displaceably received in a housing and which can be driven via a drive unit; a microswitch that can switch the drive unit on and off is provided, which is switchable upon an axial displacement motion of the tool holder via an actuating element. The actuating element is joined axially solidly to the tool holder, so that the axial displacement motion of the tool holder at the same time acts as the displacement motion of the actuating element, which motion actuates the microswitch.

21 Claims, 4 Drawing Sheets

HANDHELD POWER TOOL, IN PARTICULAR A POWER DRILL OR SCREWDRIVER

This application is based on German Patent Application DE 10 2007 019 434.1 filed Apr. 25, 2007, upon which priority is claimed under 35 U.S.C. 119(a)-(d).

BACKGROUND OF THE INVENTION

1. Field of the Invention

The invention relates to a handheld power tool, in particular to a power drill or power screwdriver, such as a battery-operated drill or screwdriver.

2. Description of the Prior Art

U.S. Pat. No. 5,557,990 discloses a battery-operated screwdriver which includes a tool holder, received displaceably in a housing, for receiving a tool; the tool holder is driven by an electric drive motor. The battery-operated screwdriver is provided with a push-start mechanism, which enables automatic starting of the drive motor as soon as the tool in the tool holder is placed with pressure on the screw to be screwed in or unscrewed and the tool holder has been displaced axially backward some distance into the housing, whereupon a switching mechanism is actuated that switches on the electric motor. A radially projecting actuating element is axially displaced by the tool holder and pressed against a microswitch by way of which the electric motor is to be switched on and off; with the aid of a spring element, the tool holder is displaced backward to its original position as soon as the screwdriver is moved away from the screw. The actuating element, which is acted upon by the tool holder and switches the microswitch on and off, is located in the housing of the power tool on the axial face end of the tool holder and is pressed by the spring element against the face end of the tool holder.

OBJECT AND SUMMARY OF THE INVENTION

With this prior art as the point of departure, the object of the invention is to equip a handheld power tool, in particular a power drill or power screwdriver, with an improved, structurally simply constructed push-start mechanism which functions reliably even over a long service life of the power tool.

The handheld power tool of the invention, which in particular is a power drill or power screwdriver or a battery-operated screwdriver, has a tool holder that is received displaceably in a housing and which is embodied for instance for receiving a screwdriver; the tool holder can be driven by means of a drive unit. The drive unit is switched on and off by a microswitch, which upon an axial displacement motion of the tool holder can be switched via an actuating element. This actuating element is axially solidly joined to the tool holder and executes the same displacement motion as the tool holder, so that its displacement motion at the same time represents the switching motion that acts on the microswitch.

This embodiment has the advantage that only relatively few components are needed to realize the push-start mechanism of the handheld power tool. The actuating element, by way of which the microswitch is switched on and/or off, is unable to execute any relative motion with respect to the tool holder, at least in the axial direction but expediently in the circumferential direction as well; instead, it is solidly joined to the tool holder, so that the adjusting motion of the tool holder is converted directly into the switching motion of the microswitch. As a result, additional spring elements for the actuating element can be dispensed with. Both the switching-on motion and the switching-off motion are executed with a high degree of safety and reliability.

In a practical refinement, the tool holder is in rotary engagement with a driven shaft and is retained axially adjustably relative to the driven shaft. The driven shaft is advantageously driven by the drive shaft of the drive unit and in particular is rotationally connected to the drive shaft via a coupling member; the coupling member allows a shutoff of the drive unit in the event that the tightening moment or torque that is transmitted by the tool holder reaches or exceeds the value of the coupling torque. This shutoff mechanism for the coupling member, in addition to the shutoff mechanics, is embodied via the push-start mechanism, so that shutoff of the drive unit occurs when the preset torque is reached, both in the event of a returning axial motion of the tool holder and with the tool holder pushed into place while the power tool is in operation.

The driven shaft, by way of which the driving motion of the drive unit is transmitted to the tool holder, advantageously has a face-end recess, in which a spring element, in particular a compression spring with which the tool holder cooperates, is received. For that purpose, the face end of the tool holder remote from the tool rests on the spring element in the recess in the driven shaft, and an axial displacement motion of the tool holder into the housing of the handheld power tool takes place counter to the force of the spring element. As soon as the handheld power tool is taken away from the workpiece being machined, the tool holder, under the influence of the spring element, can axially resume its outset position, whereupon the actuating element on the tool holder is likewise axially restored, and the microswitch that switches the drive unit is shifted into the off position.

The actuating element is expediently embodied structurally as an actuation ring joined axially solidly to the tool holder and seated on the outer jacket face of the tool holder. A radially projecting actuation tab is embodied preferably in one piece on the actuating element; it cooperates with the microswitch and adjusts it between the ON and OFF positions.

It may also be practical to provide a lighting means on the handheld power tool that is switched on and/or off by the displacement motion of the tool holder. Switching the lighting means on and off is expediently likewise effected via the microswitch. As the lighting means, a light-emitting diode or LED is preferably considered.

The drive unit is embodied in particular as an electric drive motor, whose rotor shaft forms the drive shaft that is connected via the coupling member to the driven shaft that drives the tool holder. Optionally, a gear is disposed in the transmission path between the drive motor and the tool holder.

BRIEF DESCRIPTION OF THE DRAWINGS

The invention will be better understood and further objects and advantages thereof will become more apparent from the ensuing detailed description of a preferred embodiment, taken in conjunction with the drawings, in which.

DESCRIPTION OF THE PREFERRED EMBODIMENT

Figure 1:
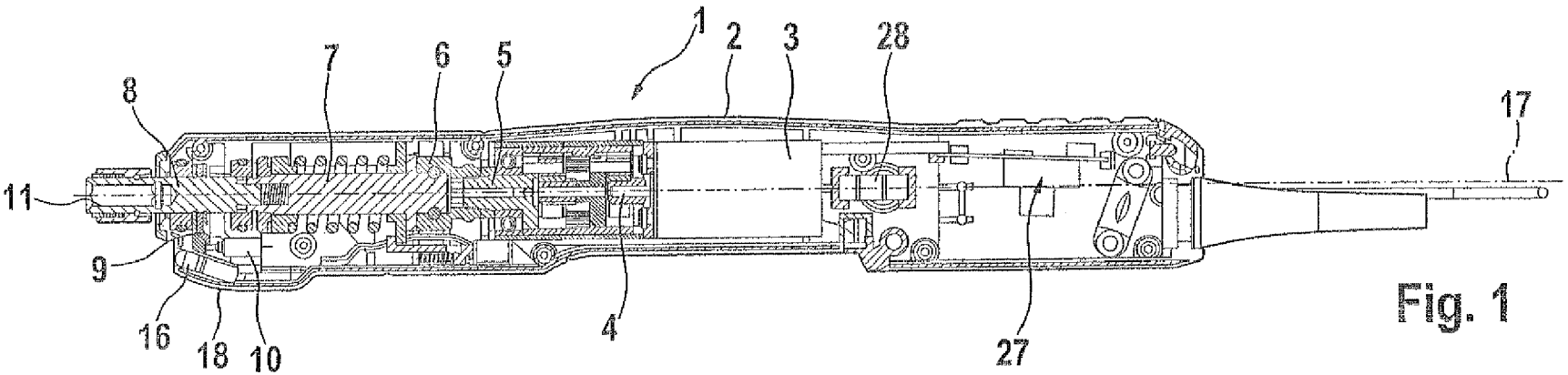
FIG. 1 is a section through a handheld power tool, embodied as an in-line screwdriver that has a power cord and that is equipped with a push-start mechanism.

In the drawings, identical components are identified by the same reference numerals.

Figure 4:
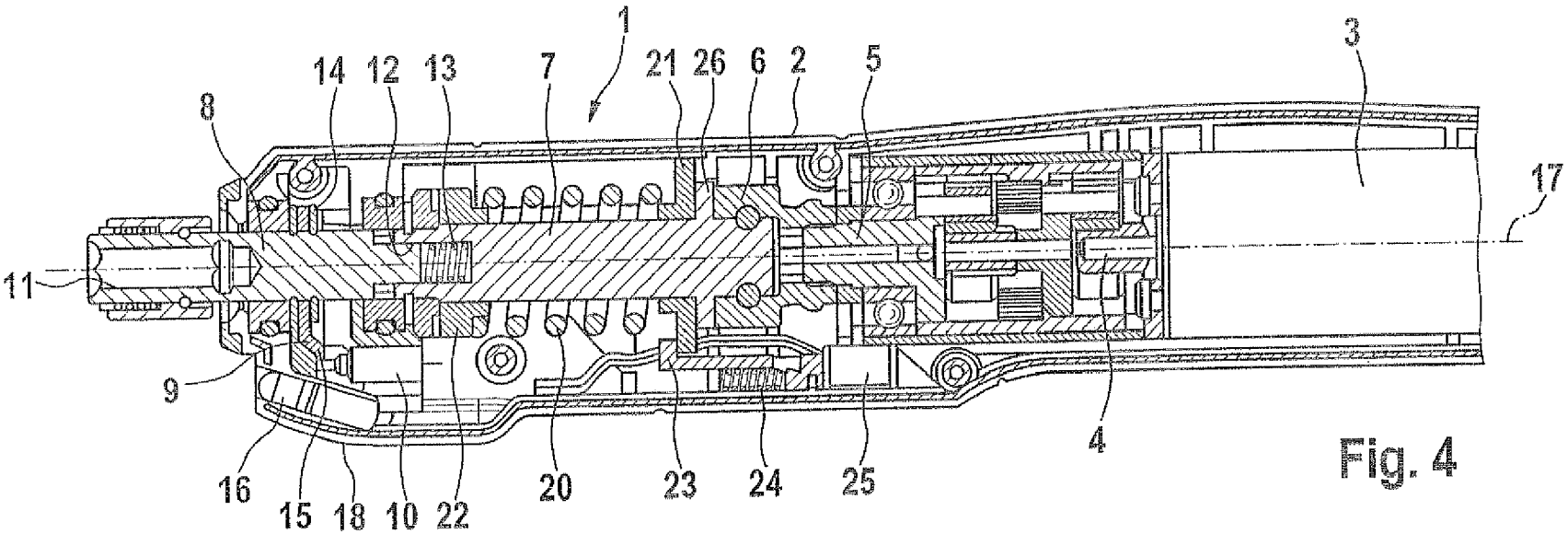
FIG. 4 is a fragmentary view, corresponding to FIG. 1, of the handheld power tool, but in an enlarged view of the front part, in which the tool holder with the push-start mechanism is received.

As FIG. 1 and the enlarged view in FIG. 4 show, the screwdriver 1 has a housing 2, in which an electric drive motor 3 is received. The rotor shaft 4 of the electric drive motor 3 acts as the drive shaft, which via a planet carrier 5 is connected by the gear to a coupling member 6 in a manner fixed against relative rotation; for transmitting a preset maximum torque, the coupling member 6 is seated on a driven shaft 7. The driven shaft 7 is connected in a manner fixed against relative rotation to a tool holder 8 for receiving a tool, in particular a screwdriver or screwdriver bit, and the tool holder 8, for receiving the tool, has a face-end recess 11 in a portion located outside the housing 2.

The tool holder 8 is retained axially displaceably relative to the driven shaft 7 but is joined positively to the driven shaft in the rotary direction, so that the rotary motion of the driven shaft 7 is also transmitted to the tool holder 8. A recess 12 (FIG. 4) is made in the face end of the driven shaft 7, and a spring element 13 embodied as a compression spring is inserted into this recess. The spring element 13 is acted upon by a peg of tapered cross section of the tool holder 8 that protrudes into the recess 12. As long as no forces are acting on the tip, which receives the tool, of the tool holder 8, the tool holder 8 is maximally forced out of the housing 2 of the battery-operated screwdriver 1 in the axial direction because of the spring force of the spring element 13.

Because of the axial displaceability of the tool holder 8, the tool holder can be shifted axially inward counter to the force of the spring element 13, as soon as the tool, received in the recess 11 in the tool holder 8, is pressed against a screw or the like. The actuating element 9, located solidly on the jacket face of the tool holder 8, thereupon comes into contact with the microswitch 10 and puts it in the ON state, whereupon the microswitch 10, which is connected to the electronics of the drive motor 3, switches this motor on. The actuating element 9 comprises an actuation ring 14, which surrounds the jacket face of the tool holder 8 and is expediently axially retained by two securing rings, and an actuation tab 15, which is embodied in one piece with the actuation ring 14 and is embodied as a radially projecting portion that extends in the direction of the microswitch 10 and is embodied for actuating the microswitch 10.

As soon as the tool received in the tool holder 8 is force-free, the tool holder 8, under the influence of the spring element 13, is axially displaced back into its outset position, in which the tool holder protrudes maximally far out of the housing 2. The actuating element 9 thereupon becomes disengaged from the microswitch 10, so that the microswitch 10 is converted from the ON to the OFF state, and the electric drive motor 3 is switched off.

The actuating element 9 is solidly joined in the axial direction to the tool holder 8, but the actuating element 9 does not execute the rotary motion of the tool holder 8; instead, it is solidly joined in the rotary direction to the housing 2 of the screwdriver 1.

In the lower, front part of the housing 2, there is a lighting means 16, embodied in particular as a light-emitting diode (LED), which illuminates the work field of the handheld power tool. For that purpose, the lighting means 16 is located at an oblique angle to the longitudinal axis 17 of the handheld power tool, in such a way that the free face end of the tool holder 8 and the areas in front of the face end are all illuminated. The lighting means 16 is received in a bulging portion 18 of the housing 2.

The lighting means 16 is switched on and off via the axial displacement motion of the tool holder 8. This is done in particular in such a way that the switching state of the lighting means 16 is controlled via the microswitch 10, which thus has the task not only of switching the electric drive motor 3 on and off but also of switching the lighting means 16 on and off. Switching the lighting means 16 on and off is thus done in the same way as the switching on and off of the electric drive motor. Optionally, however, only switching on is done via the microswitch and hence via the electronics 27 of the drive motor, while switching off is conversely done in a timed manner via the electronics.

Figure 2:
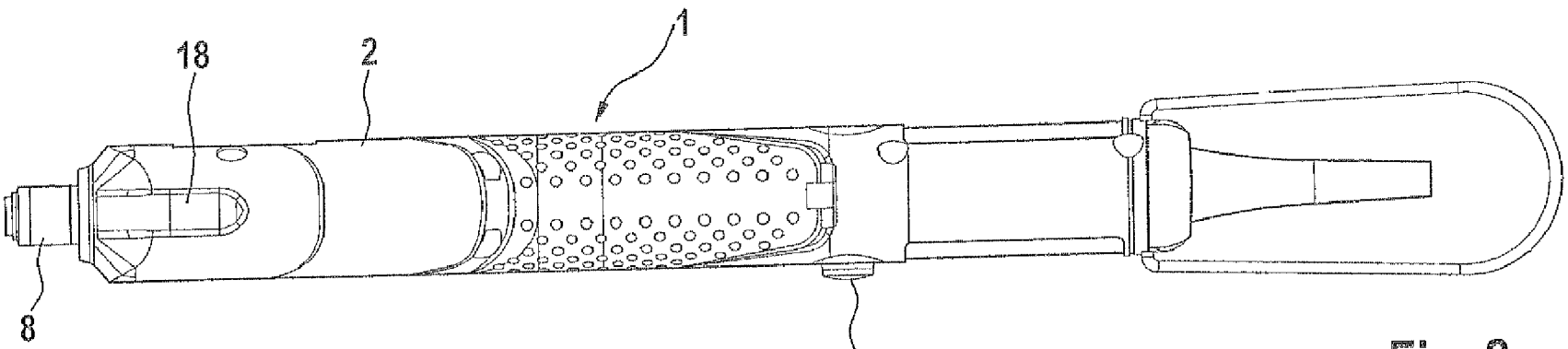
FIG. 2 shows the handheld power tool in a view from below.
Figure 3:
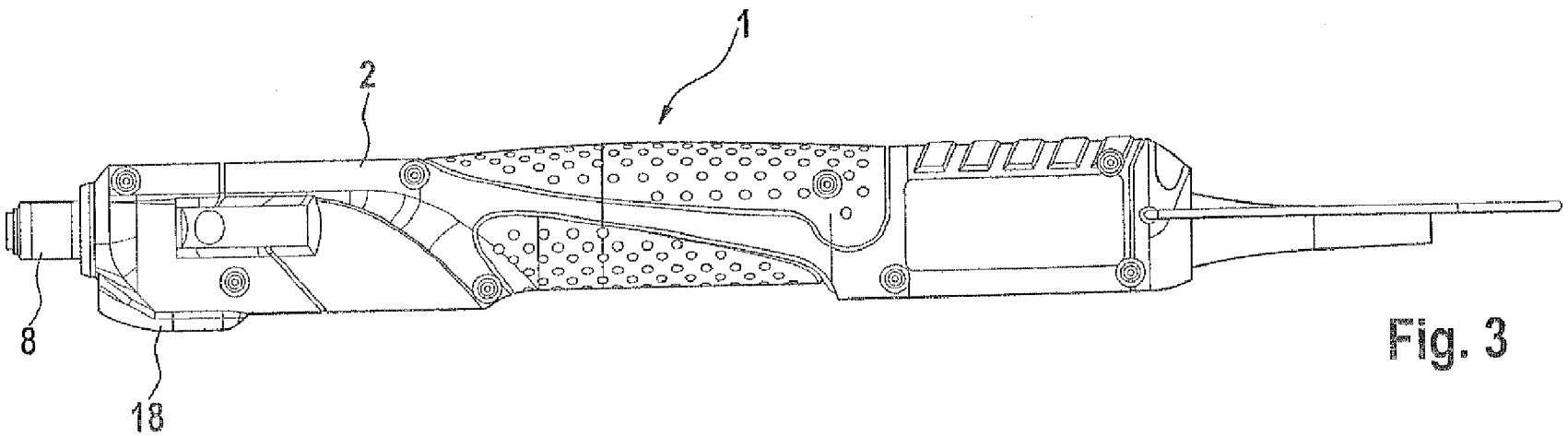
FIG. 3 shows the handheld power tool in a side view.

Switching the lighting means 16 on and optionally also off can also be done via a rotation-direction setting switch 19 (FIG. 2), by way of which the direction of rotation of the tool holder 8 can be fixed or reversed. In the exemplary embodiment, the rotation-direction setting switch 19 is located in the lateral area of the housing and is embodied as a spring-loaded push button, which presses on a further microswitch 28 which is located inside the screwdriver. The shutoff of the lighting means is typically done in timed fashion via the electronics 27 of the drive motor.

Figure 5:
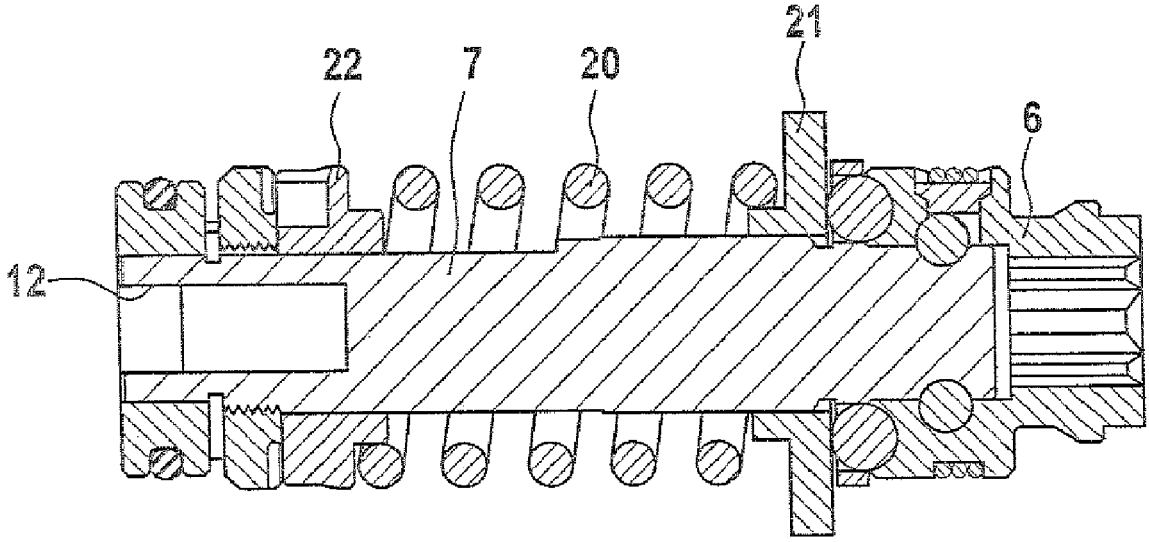
FIG. 5 is an individual sectional view showing the driven shaft of the handheld power tool, the shaft being connected on one end to a coupling member and on the other end having a recess for a spring element that acts upon the face end of the tool holder.

As further shown in FIGS. 4 and 5, the shutoff of the electric drive motor can also be done via a torque shutoff device. The torque shutoff device includes a switching element 23, which is subjected to force by a compression spring 24 and is kept by the compression spring in contact with a shutoff microswitch 25; in the contact position of the switching element 23, the shutoff microswitch 25 is on. The switching element 23 is retained axially adjustably in the housing 2 and can be put into the out-of-contact position with the shutoff microswitch 25 by a bearing disk 21, which is seated on the jacket face of the driven shaft 7 and is located axially displaceably on the driven shaft. The bearing disk 21 is located on the side of the driven shaft facing toward the coupling member 6 and defines one end of a compression spring 20 that is embodied as a spiral spring and that on the other end is fixed on the driven shaft 7 by a second bearing disk 22. The bearing disk 21 moves axially away from the coupling member 6 as soon as the tightening torque of the tool holder 8, or of the tool received in it, matches the torque of the coupling member 6. In this axial motion—to the left in terms of FIGS. 4 and 5—the switching element 23 is displaced out of the contact position with the shutoff microswitch 25 into the out-of-contact position, counter to the force of the compression spring 24, whereupon the shutoff microswitch 25, via the electronics, shuts off the electric drive motor 3. As already noted, the shutoff may, however, also be done in timed fashion via the electronics 27.

As soon as the bearing disk 21, by the force of the compression spring 20, is displaced back into its outset position, in which the bearing disk 21 rests axially on an annular shoulder 26 of the driven shaft 7, the switching element 23 also, by the force of the compression spring 24, again moves toward the shutoff microswitch 25, whereupon this shutoff microswitch is displaced into the ON position that switches the electric drive motor on.

Advantageously, the lighting means 16 is shut off automatically, as soon as the shutoff microswitch 25 switches the electric drive motor 3 off.

It may also be practical for the lighting means 16 not to be switched off until a preset length of time has elapsed, via a time switch after the completion of the work step or in other words after the shutoff of the electric drive motor. In that case, the shutoff of the lighting means 16 occurs only with a time lag after the shutoff of the electric drive motor.

The foregoing relates to a preferred exemplary embodiment of the invention, it being understood that other variants and embodiments thereof are possible within the spirit and scope of the invention, the latter being defined by the appended claims.

I claim:

1. A handheld power tool, in particular a power drill or power screwdriver or battery-operated screwdriver, the power tool including a tool holder received axially displaceable in a housing, a drive unit operable to drive the tool holder, a microswitch operable to switch the drive unit on and off, and an actuating element operable upon an axial adjusting motion of the tool holder to actuate the microswitch, the improvement comprising means axially joining the actuating element solidly to the tool holder whereby the axial displacement motion of the tool holder simultaneously represents the adjusting motion of the actuating element, which motion actuates the microswitch.

2. The handheld power tool as defined by claim 1, further comprising a driven shaft and the tool holder being in rotary engagement with the driven shaft, and means permitting axial adjustment of the tool holder relative to the driven shaft.

3. The handheld power tool as defined by claim 2, further comprising a drive shaft, and a coupling member rotatably joining the driven shaft to the drive shaft.

4. The handheld power tool as defined by claim 3, further comprising a spring element counter to whose spring force the tool holder is to be axially adjusted, disposed in the transmission path between the tool holder and the drive unit.

5. The handheld power tool as defined by claim 3, wherein the actuating element comprises an actuation ring joined axially solidly to the tool holder, the actuating ring having an actuation tab cooperating with the microswitch.

6. The handheld power tool as defined by claim 3, further comprising at least one lighting means including switching means operable by the displacement motion of the tool holder to switch the lighting means on and off.

7. The handheld power tool as defined by claim 2, further comprising a spring element counter to whose spring force the tool holder is to be axially adjusted, disposed in the transmission path between the tool holder and the drive unit.

8. The handheld power tool as defined by claim 2, wherein the actuating element comprises an actuation ring joined axially solidly to the tool holder, the actuating ring having an actuation tab cooperating with the microswitch.

9. The handheld power tool as defined by claim 1, further comprising a spring element counter to whose spring force the tool holder is to be axially adjusted, disposed in the transmission path between the tool holder and the drive unit.

10. The handheld power tool defined by claim 9, wherein the driven shaft comprises a force-end recess for receiving the spring element.

11. The handheld power tool as defined by claim 10, wherein the spring element is a compression spring.

12. The handheld power tool as defined by claim 9, wherein the actuating element comprises an actuation ring joined axially solidly to the tool holder, the actuating ring having an actuation tab cooperating with the microswitch.

13. The handheld power tool as defined by claim 9, further comprising at least one lighting means including switching means operable by the displacement motion of the tool holder to switch the lighting means on and off.

14. The handheld power tool as defined by claim 1, wherein the actuating element comprises an actuation ring joined axially solidly to the tool holder, the actuating ring having an actuation tab cooperating with the microswitch.

15. The handheld power tool as defined by claim 14, further comprising at least one lighting means including switching means operable by the displacement motion of the tool holder to switch the lighting means on and off.

16. The handheld power tool as defined by claim 1, further comprising at least one lighting means including switching means operable by the displacement motion of the tool holder to switch the lighting means on and off.

17. The handheld power tool as defined by claim 16, wherein the switching means by which the lighting means can be switched on and/or off is the microswitch.

18. The handheld power tool as defined by claim 17, wherein the lighting means is embodied as a light-emitting diode.

19. The handheld power tool as defined by claim 16, wherein the lighting means is embodied as a light-emitting diode.

20. The handheld power tool as defined by claim 1, wherein the drive unit is an electric drive motor.

21. The handheld power tool as defined by claim 1, wherein the tool holder has an outer jacket face, and the actuating element is an actuation ring joined solidly to the tool holder in the axial direction and is seated on the outer jacket face of the tool holder.

* * * * *